US005375749A

United States Patent [19]

Oliva

[11] Patent Number: 5,375,749

[45] Date of Patent: Dec. 27, 1994

[54] MULTI-PURPOSE HOLSTER APPARATUS

[76] Inventor: Ronald Oliva, 2824 NW. 8th Ave., Ft. Lauderdale, Fla. 33311

[21] Appl. No.: 88,214

[22] Filed: Jul. 6, 1993

Related U.S. Application Data

[63] Continuation-in-part of Ser. No. 752,879, Aug. 30, 1991, abandoned.

[51] Int. Cl.[5] ..... A45F 5/00

[52] U.S. Cl. ..... 224/271; 224/242; 224/252; 224/253; 224/272; 224/908; 224/904; 24/3 L; 24/191; 24/194; 24/197

[58] Field of Search ..... 224/224–226, 224/242, 245, 246, 250, 252, 253, 268, 269, 271, 272, 901, 904, 908; 24/191, 193, 194, 197, 3 L, 163 K, 616, 625; 352/243; 354/82

[56] References Cited

U.S. PATENT DOCUMENTS

| | | | |
|---|---|---|---|
| 2,551,515 | 5/1951 | Tschirf | 24/3 L X |
| 3,884,403 | 5/1975 | Brewer | 224/908 X |
| 4,091,974 | 5/1978 | McClintock | 224/908 X |
| 4,237,583 | 12/1980 | Sullivan | 224/252 X |
| 4,256,245 | 3/1981 | Serres | 224/271 X |
| 4,419,794 | 12/1983 | Horton, Jr. et al. | 224/272 X |
| 4,714,184 | 12/1987 | Young et al. | 224/253 |
| 5,014,892 | 5/1991 | Copeland | 224/271 |
| 5,201,858 | 4/1993 | Otrusina | 224/272 X |
| 5,274,318 | 12/1993 | Nordberg et al. | 224/242 X |
| 5,274,885 | 1/1994 | Hellweg | 224/272 X |

FOREIGN PATENT DOCUMENTS

| | | | |
|---|---|---|---|
| 1237437 | 3/1967 | Germany | 224/252 |
| 0225019 | 11/1924 | United Kingdom | 224/253 |

*Primary Examiner*—J. Casimer Jacyna
*Attorney, Agent, or Firm*—Malin, Haley, DiMaggio & Crosby

[57] ABSTRACT

Multi-purpose holster apparatus is provided which is suitable for holding a variety of objects including portable tools, mobile telephones, flashlights, cameras, etc. The holster employs a rigid or semi-rigid frame which has a section which mates with a corresponding section on the object to be holstered. The frame is attachable to a belt or a waistband to allow a rapid drawing of the object that is holstered.

24 Claims, 6 Drawing Sheets

Fig. 4
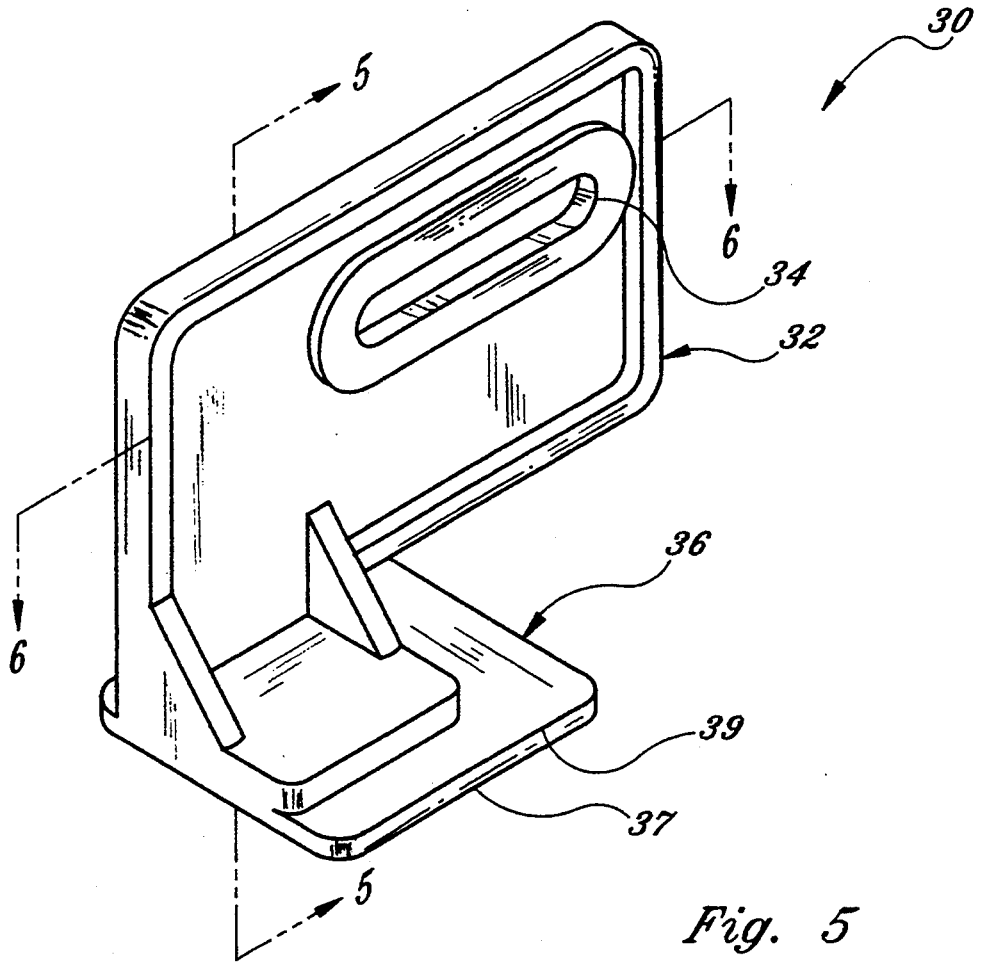
Fig. 5
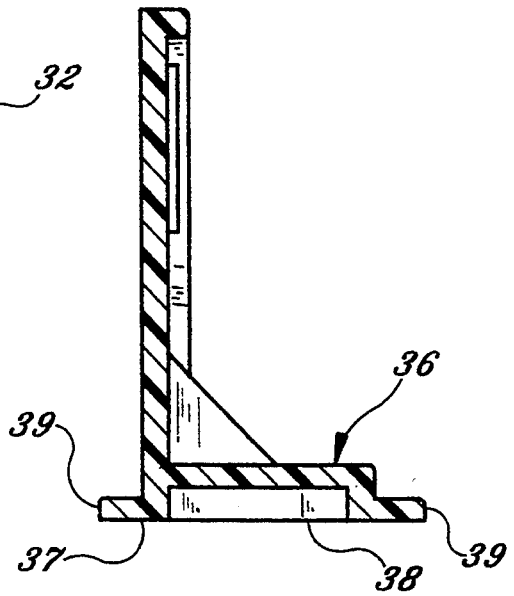
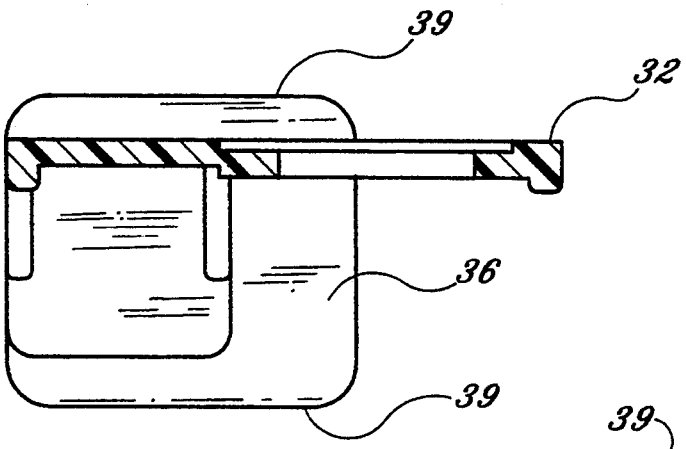
Fig. 6

Fig. 7
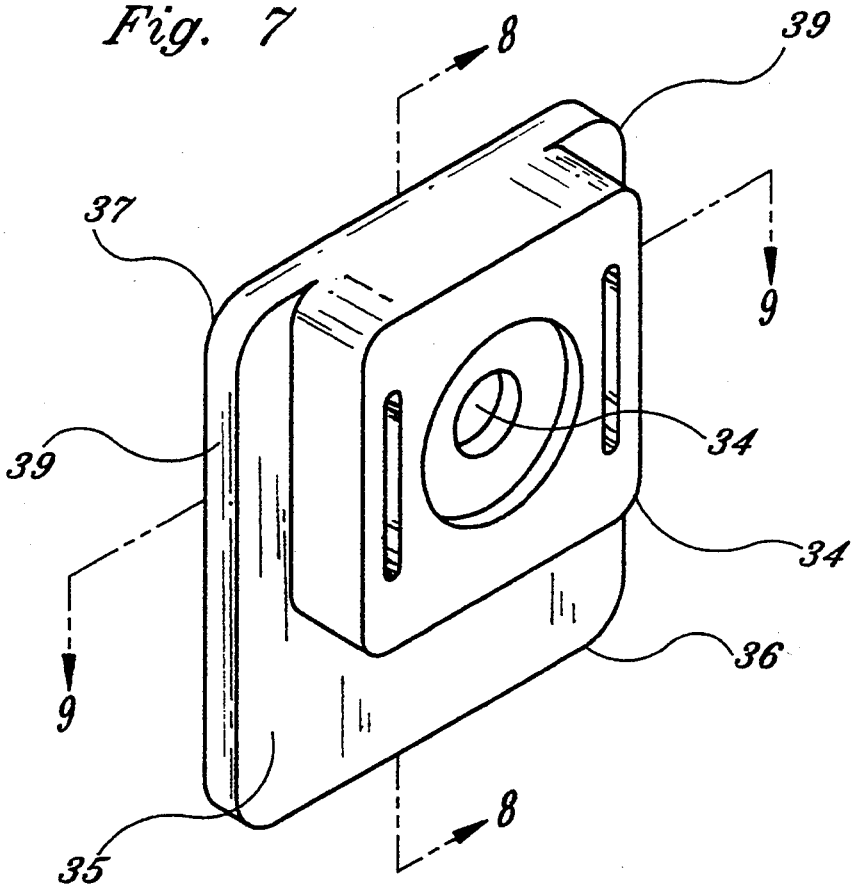
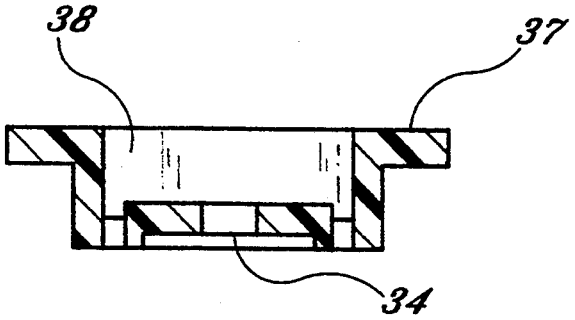
Fig. 9
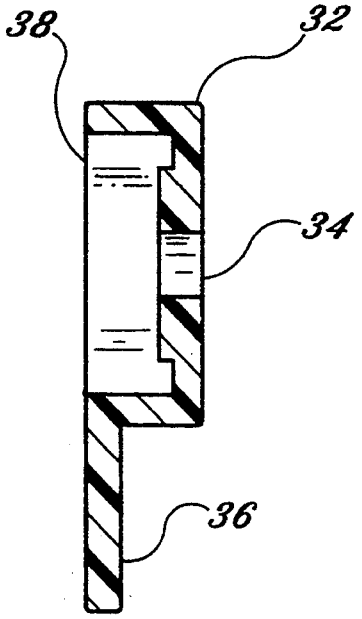
Fig. 8

MULTI-PURPOSE HOLSTER APPARATUS

This application is a continuation-in-part of U.S. Ser. No. 07/752,879 filed Aug. 30, 1991, now abandoned.

FIELD OF THE INVENTION

This invention relates generally to multi-purpose holster for securing tools and accessories to a belt, and more particularly, to a holster and belt-like arrangement that securedly supports a plurality of accessories, such as tools, mobile telephones, cameras, and the like, while permitting ready and convenient access to the articles.

DESCRIPTION OF THE BACKGROUND ART

The subject invention provides a multi-purpose holster apparatus that is an improvement over conventional holster devices, and offers an alternative to restrictive devices such as camera holders, portable tool belts, harnesses, etc. The subject holster can be used as a support for potable tools, mobile telephones, cameras, video cameras, flashlights, etc., and fulfills the long felt need for a holder which permits ready access and secure attachment. In its preferred embodiment, the subject holsters provide a readily accessible camera holder that can comfortably secure a camera in a lens down position to a user's belt or waistband and a mobile telephone holder that securedly attaches to a user's belt.

Holster-type holders are well known in the art. However, no holder/holster to date provides the accessibility and security provided by the notch, sliding clip and thumb-lock mechanism fastening means of the subject device.

U.S. Pat. No. 3,209,968, issued Oct. 5, 1965 to Flanagan, discloses a belt clip attachment for a camera which utilizes the thumb screw to directly affix the camera to a bracket which can be attached to a belt. The camera is operated with the bracket attachment still in place thus adding bulk to the camera and inconvenience to the user.

U.S. Pat. No. 4,266,706, issued May 12, 1981 to Gould, discloses a belt support that holds a camera in a lens down position. This support attaches a camera to the user's belt by means of a strip of an elastic material. U.S. Pat. No. 4,120,434, issued Oct. 17, 1978 to Hewes, also discloses a belt supported camera caddy which holds the camera in a lens down position. Neither of these patents, however, disclose applicant's easy access system for attaching a camera to a holster apparatus or the closable lens strap design of the subject invention.

U.S. Pat. No. 3,762,616, issued Oct. 2, 1973 to Brunstetter, discloses a camera holster which comprises a "pocket" for inserting a camera. The entire pocket and camera is then attached to a belt. As in typical of the prior art, immediate access to the camera is prohibited.

Other holster-like apparatuses described in the prior art include U.S. Pat. No. 4,621,753, issued Nov. 11, 1989 to Ridings, which describes a belt supported tool carrier, and U.S. Pat. No. 1,928,063, issued Sep. 26, 1933 to Lehmann, which describes a holder for a headed tool. In contrast, the subject invention is not limited to use with headed tools.

Unlike earlier holders, the slide-plate and corresponding receptacle of the subject invention permits a variety of objects to be securely affixed to the user's belt while allowing the user immediate access to the object. Although the subject invention is particularly suitable for use with cameras having long lens and video cameras, it is adaptable to hold a plethora of different devices.

SUMMARY OF THE INVENTION

It is an object of the instant invention to provide a multi-purpose holster with a belt or for attachment to a belt, for holding accessories such as, tools, cameras, video cameras, flashlights, mobile telephones, etc., which affords convenient and ready access to the accessories.

It is another object of this invention to provide a multi-purpose holster that securedly attaches accessories to a belt such that risk of loss from carelessness or theft is substantially reduced or prevented.

It is a further object of this invention to provide a multi-purpose holster that is comfortable to wear.

It is an additional object of this invention to provide a multi-purpose holster which is convenient for extended and everyday use.

These and other objects are achieved by the present invention which contemplates a multi-purpose holster arrangement for carrying one or more tools and accessories to afford ready, convenient access and secure attachment.

The subject invention provides a holster apparatus which generally comprises at least one frame adaptable for attachment to a belt, strap, waistband or the like; an interlocking member or support member attached to and extending from each object to be holstered; and a support member receptacle or sleeve which engages the support member with the frame.

The frame is typically rigid or semi-rigid and has a plurality of apertures through which a belt, strap, waistband or the like may be threaded. Preferably, the frame is rectangular or trapezoidal in overall appearance, but may be otherwise and still fall within the scope of the invention.

The sleeve provides a typical means for engaging the frame with the interlocking member. The sleeve is fixedly secured to the frame with the sleeve preferably being configured so as to slidably engage with the support member. The support member often includes a slidable plate and is adapted for attachment to the objects to be held. The slidable plate mates with the sleeve such that the sleeve rigidly secures the support member which supports the object. That is, the sleeve and slidable plate are designed so that their dimensions are complimentary. To facilitate manufacture, the sleeve and the frame may be integrally formed and may be constructed using a single mold. To ensure that the support member does not disengage from the sleeve, the frame typically includes a locking mechanism.

The subject invention may include a strap as a second means for securing the object to be holstered to the frame. Preferably, the strap is attachable to itself, most preferably by a buckle or a multiplicity of interlocking hooks and filaments, such as VELCRO.

In an additional embodiment, the sleeve is replaced by a female adaptor having a notched center while the interlocking member is substituted for a corresponding male adapter. The female adapter protrudes from the frame and typically has a recession that mates and interlocks with the male adaptor. The male adapter generally comprises a cylindrical member having a circumferential groove that firmly engages the female adapter. Moreover, a locking mechanism may be provided which comprises a channel above the recession and a slidable key insert that keeps the male adapter within the female adapter.

In accordance with these and other objects which will be apparent hereinafter, the instant invention will now become described with particular reference to the accompanying drawings.

BRIEF DESCRIPTION OF THE DRAWINGS

FIG. 4 shows a perspective view of a second connector suitable for use with the first subject holster device. The illustrated connector is designed to attach to a camcorder.

FIG. 5 shows a cross-sectional view of the second connector illustrated in FIG. 4 taken along plane 5—5.

FIG. 6 shows a cross-sectional view of the second connector depicted in FIG. 4 taken along plane 6—6.

FIG. 7 shows a perspective view of a second connector for use with the first subject holster device. The illustrated connector is designed to attach to a 35 mm camera.

FIG. 8 shows a cross-sectional view of the connector depicted in FIG. 8 taken along plane 8—8.

FIG. 9 shows a cross-sectional view of the connector illustrated in FIG. 8 taken along plane 9—9.

DESCRIPTION OF THE PREFERRED EMBODIMENTS

Figure 1:
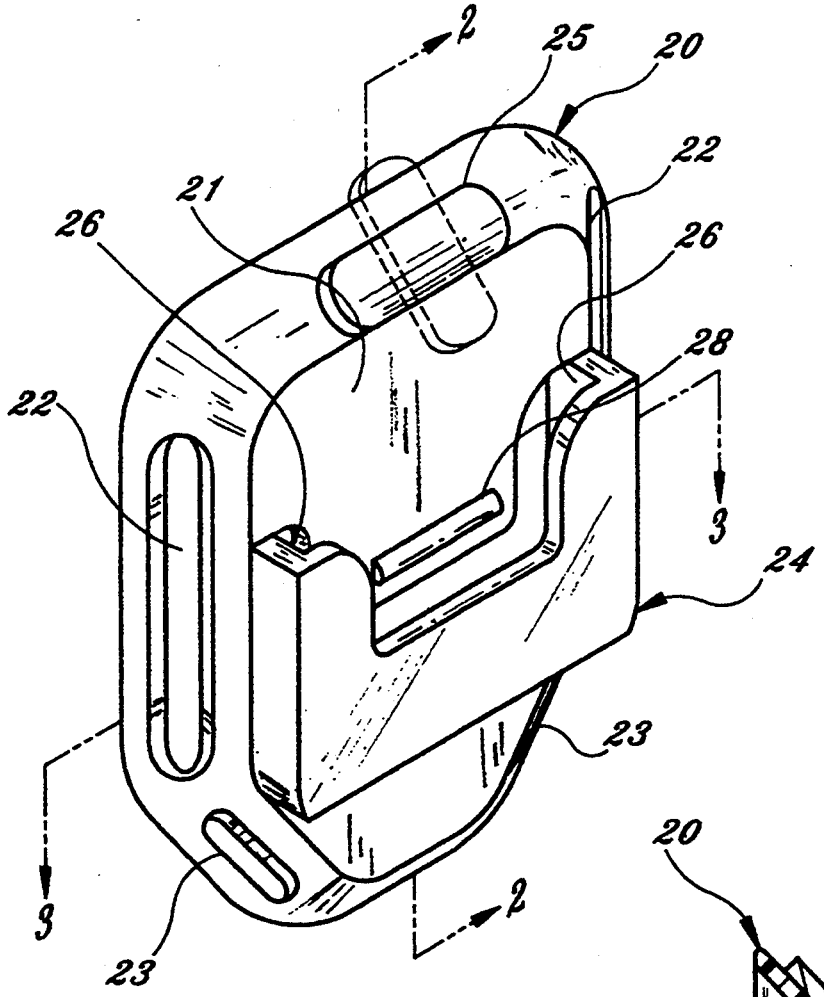
FIG. 1 shows a perspective view of the first subject holster apparatus.

With reference to the drawings, FIGS. 1–20*a* depict a multi-purpose holster apparatus generally shown in FIG. 1, comprising at least one frame 20, a support member 32 and a slidable interlocking plate 36. The holster apparatus may also include a belt, strap, waistband or the like as referenced by the numeral 50 in FIG. 17. The holster is suitable for use in a variety of different applications including holding mobile telephones, portable tools, cameras, flashlights, baby bottles etc. The device utilizes a rigid or semi-rigid frame 20. Typically, the frame 20 is fabricated from a plastic or a metal. However, any rigid or semi-rigid material including wood, leather, cardboard, etc. may be employed.

The frame 20 may be of any suitable shape. Typically, this shape is quadrilateral. FIG. 1 depicts the frame 20 as a trapezoid having its center portion 21 on a plane raised above the peripheral edges 29 (see FIGS. 2 and 3 for cross-sectional views). A plurality of frames 20 of varying shapes may be utilized in the preferred embodiment to hold a variety of objects.

Figure 12:
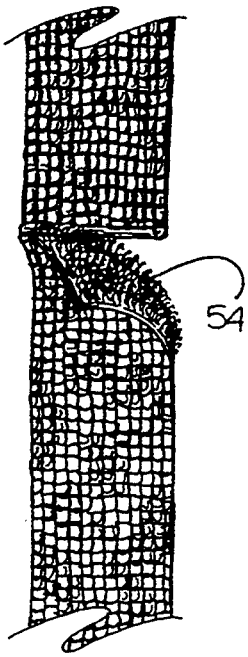
FIG. 12 shows a perspective view of a VELCRO fastener as an alternative to the buckle fastener.
Figure 13:
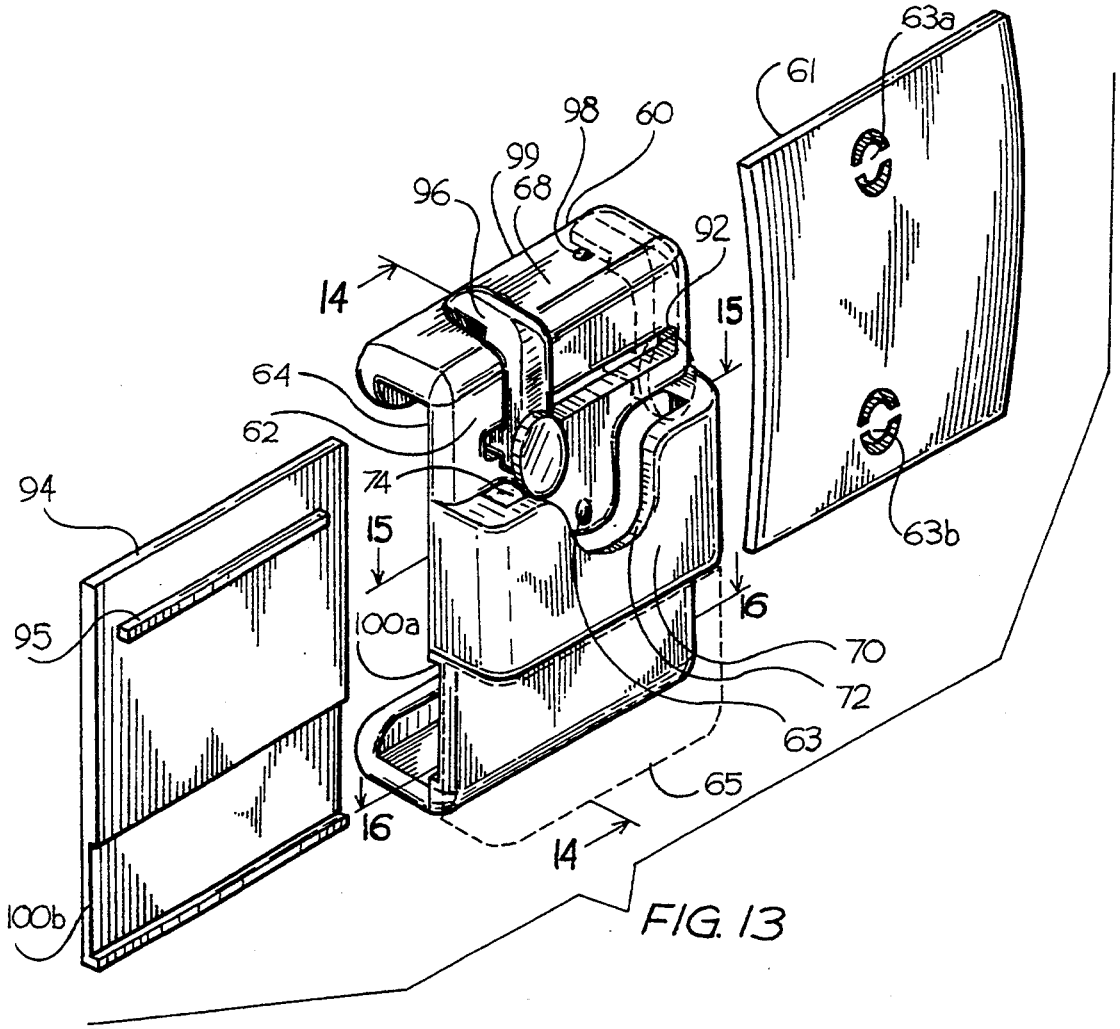
FIG. 13 shows a perspective view of a second holster apparatus.
Figure 14:
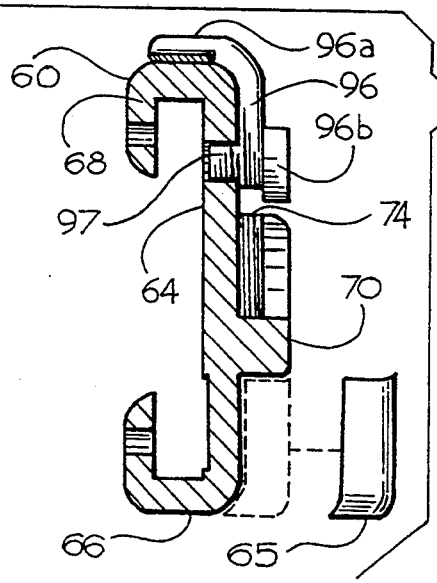
FIG. 14 shows a cross-sectional view of the second holster apparatus taken along plane 14—14 of FIG. 13.
Figure 15:
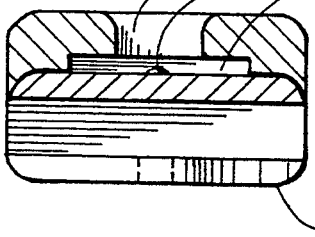
FIG. 15 shows a cross-sectional view of the second holster apparatus depicted in FIG. 13 taken along plane 15—15.
Figure 16:
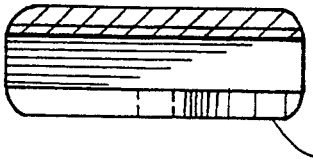
FIG. 16 shows a cross-sectional view of the second holster apparatus depicted in FIG. 13 taken along plane 16—16.
Figure 17:
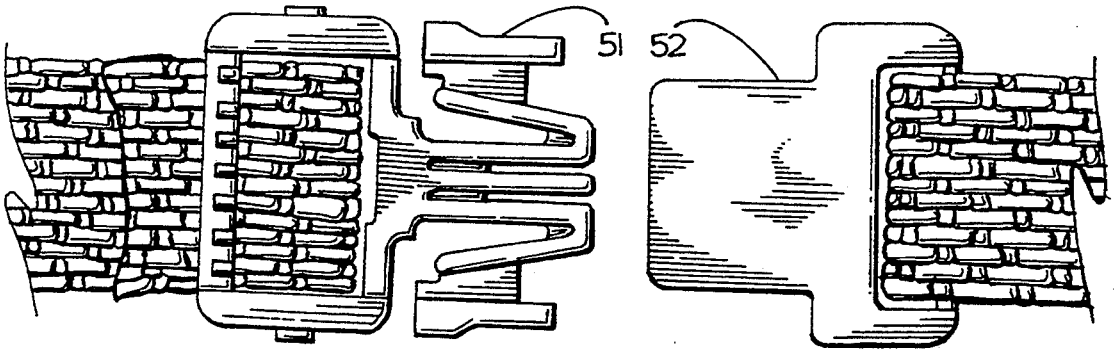
FIG. 17 shows a perspective view of a typical belt with a buckle fastener used for supporting the first and/or second holster apparatus around the waist of a user.
Figure 20A:
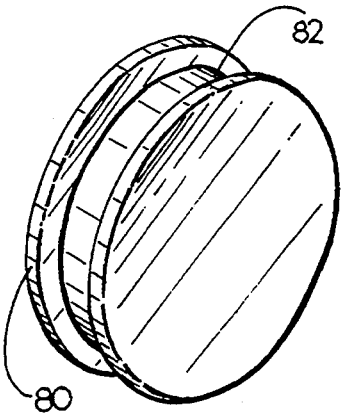
FIG. 20*a* is an expanded view of the male adapter.
Figure 20:
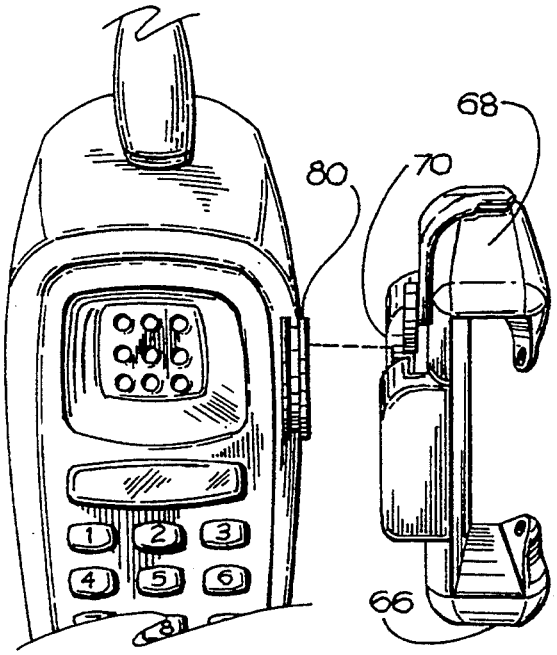
FIG. 20 shows an elevational view of the male adapter attached to an object and exploded from the second holster apparatus.
Figure 18:
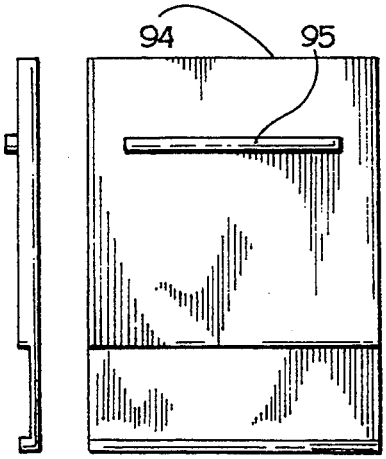
FIG. 18 shows front and side elevational views of the planar securing member of the second holster apparatus.
Figure 19:
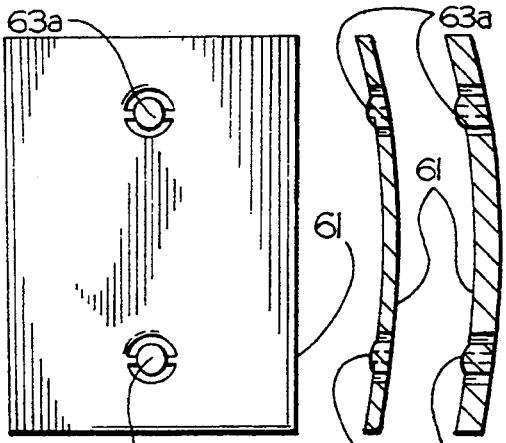
FIG. 19 shows front and side elevational views of the spacers of the second holster apparatus, with the side views depicting the varying widths for individual spacers.

Defined by the frame are means for fastening the frame to a belt, strap, waistband or the like. In the preferred embodiment of the subject invention, the means for attaching the frame 20 to a belt, waistband or strap comprises a plurality of apertures 22 through which the belt 50, waistband or strap may transverse. Other suitable means for fastening the frame to the belt, strap, waistband or the like include, but are not limited to buckles, clips, rivets, bolts, ties, snaps, VELCRO (VELCRO is a trade name for a multiplicity of interlocking filaments and hooks), etc. The belt as depicted in FIG. 17 uses a buckle having a male 51 and female 52 section to fasten or join the belt ends, but other means including VELCRO 54 as shown in FIG. 12 may be employed.

The frame 20 is connected to the object to be holstered by way of interlocking connectors. The first connector is preferably integrally formed with the frame 20 and shaped as a receptacle or sleeve 24 to accept an interlocking plate 36 which slides therein. The second connector 30 comprises a support member 32 and a slidable interlocking plate 36 as illustrated in FIG. 4 for attaching video cameras and in FIG. 7 for attaching still picture cameras. The support member 32 attaches to the object to be holstered. The slidable interlocking plate 36 slides into the sleeve 24 which has marginally larger but complimentary dimensions for snugly mating with the plate 36. In the preferred embodiment, the support member 32 and the plate 36 are integrally formed, however, they may be fixedly connected together and still fall within the scope of the instant invention.

Figure 3:
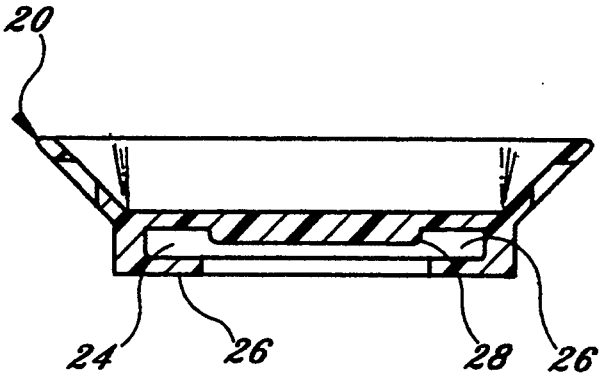
FIG. 3 shows a cross-sectional view of the first holster apparatus taken along plane 3—3 of FIG. 1.
Figure 2:
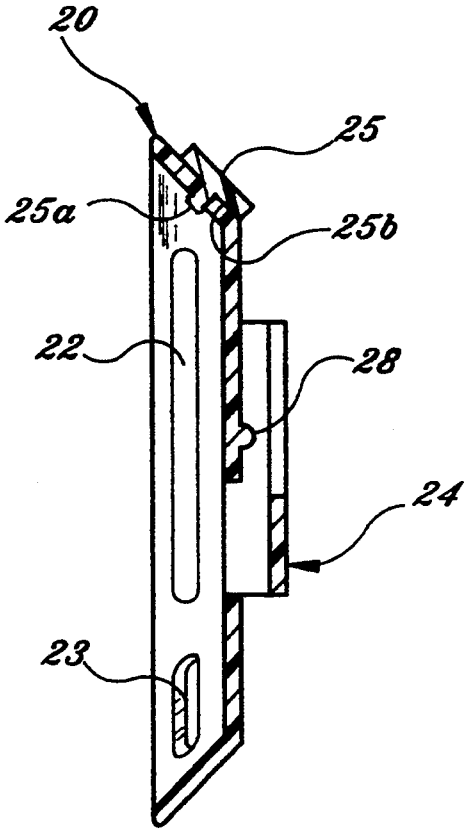
FIG. 2 shows a cross-sectional view of the first holster apparatus taken along plane 2—2 of FIG. 1.
Figure 10:
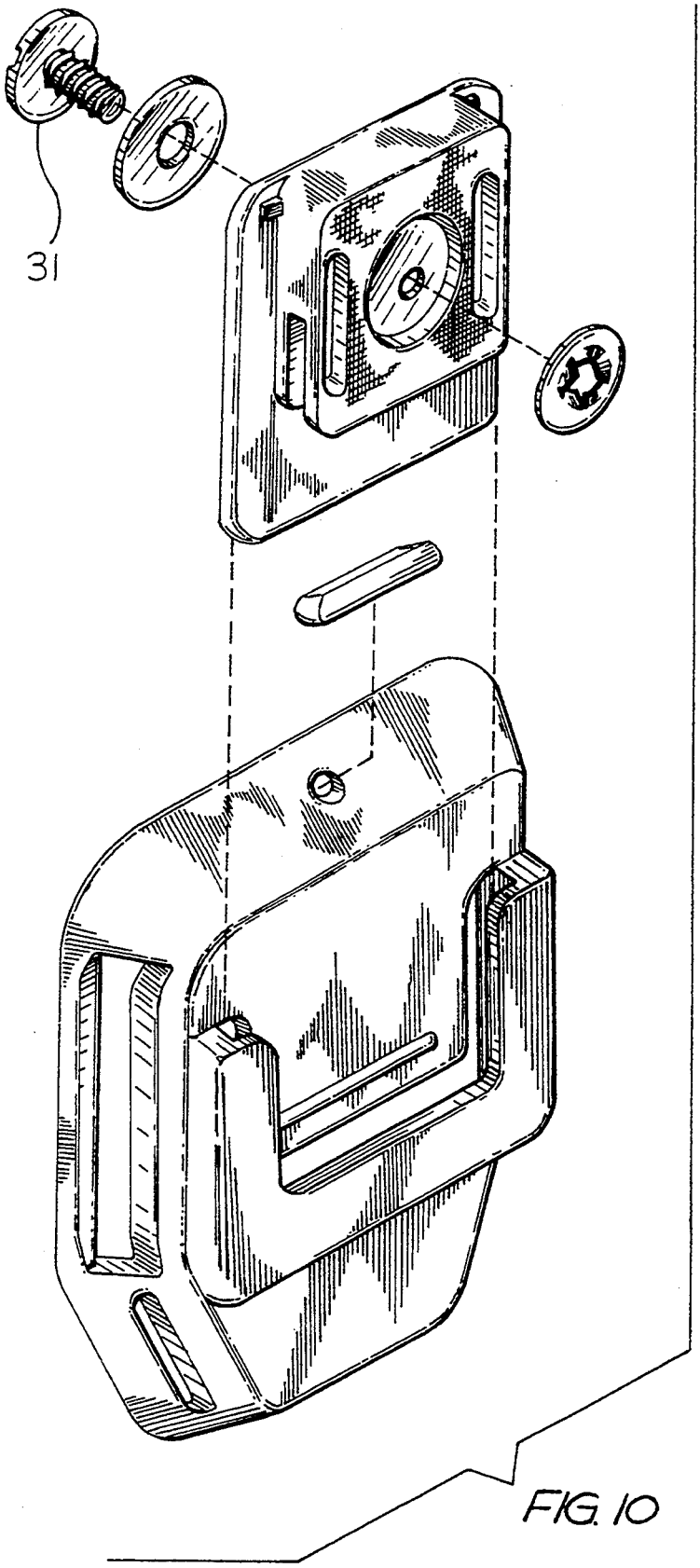
FIG. 10 shows an exploded view of the second connector illustrated in FIG. 7 and the second connector.

With reference to FIGS. 1–3, the first connector is typically constructed as a sleeve 24 having channels 26 formed along the two edges of the receptacle perpendicular to the belt 50. The channels 26 are formed so that the plate 36 of the second connector 30 slidably seats through an opening at the top of the sleeve 24. The downward motion of the second connector 30 may be stopped by a raised area, by the termination of the channels 26, or alternatively, by a narrowing at the bottom end of the channel 26. In the preferred embodiment, the frame 20 provides a first locking mechanism to secure plate 36 in the sleeve 24 comprising an elongated raised projection 28 protruding from the center portion 21 and a corresponding cutout 38 defined by the backside 37 of plate 36. The center portion 21 of the frame 20 may contain one or more raised projections 28 to interlock the plate 36. When the plate 36 is inserted into sleeve 24 via channels 26, the cutout 38 engages the projection 28 to securedly interlock the second connector 30 to the frame 20 by asserting a force upon the back of the slidable plate 36. This makes removal of the second connector 30 from the first connector 24 more difficult, and prevents the object being holstered from disengaging due to theft or user motion (e.g. walking, running, climbing, etc.). The slidable plate 36 may be constructed as a tripartite system. The side edges 39 of the slidable plate 36 engage with the channels 26. The back center section 37, which is slightly bent out of planar alignment with the other two sections to form cutout 38, engages with the raised projection 28 so as to securely hold the second connector 30 to the frame 20.

To further prevent the connectors 24 and 30 from disengaging, the subject holster may contain a second locking mechanism 25. Preferably, the locking mechanism 25 is pivotally mounted on the frame 20 as shown in FIG. 2, wherein a depending plug **25*a* is inserted into a plug aperture 25*b* of frame 20. When it is in an open position (solid line) the second connector 30 can be slidably seated in the sleeve 24, whereas, when the locking mechanism 25 is in the closed position (broken line), removal of the first connector 24 from the second 30 is blocked. Accordingly, three different "locks" may be provided to hold the second connector 30 in place, i.e., the channels 26, the raised projection 28 and cutout 38, and the locking mechanism 25**.

The second connector 30 is mounted upon the object to be holstered via the support member 32 and constructed so as to interlock with the first connector 24 as aforementioned. FIGS. 4–6 depict the support member 32 and plate 36 for supporting a video camera, while FIGS. 7–9 depict the support member 32 and plate 36 for a still frame camera. The support member 32 of the second connector 30 includes a mounting aperture 34 for receiving a threaded bolt 31, see FIG. 10, or it may be fitted with a protruding threaded bolt 31 onto which an object may be mounted. In the preferred embodiment, the threaded bolt 31 is designed to fit into the female threaded thumb screw receptor of a 35 mm camera, a video camera, or other similar style camera. Alternatively, the threaded portion may be designed to engage in the female tripod screw receptor of a conventional camcorder (included as camcorders are VHS, super VHS, 8 mm and conventional movie cameras). Although two above-described embodiments are designed for holding cameras, it is to be understood that the subject invention is adaptable to secure other transportable pieces of equipment such as mobile telephones, flashlights, etc. In such cases, the protruding threaded bolt 31 may be replaced by a hook, self-tapping screw, molly-type bolt, tie, etc. Two-sided tape having adhesive on both sides has been found particularly well suited for affixing the second connector 30 to the object to be holstered. It should also be recognized that the support members 32 may be structurally designed and oriented with respect to the plate 36 to accommodate the desirous object to be held. For instance, to support a video camera the support member 32 projects substantially perpendicularly from one edge of the plate 36 as shown in FIG. 4. The mounting aperture 34 defined by the support member 32 is elongated to accommodate various video cameras. To support a camera the support member 32 protrudes from the front side 35 of plate 36 such that the aperture 34 is parallel to the front side 35, as depicted in FIG. 7.

FIG. 1 shows the frame 20 and the sleeve 24 formed from a single contiguous piece of material. This advantageously allows the holster to be manufactured by processes such as injection molding of plastics or metal, and offers the economic advantages of a single mold and no assembly. The bottom of the channels 26 may be closed to stop downward motion of the slidable plate 36 or opened as in the preferred embodiment wherein the support member 32 and first locking mechanism stop downward motion. In FIGS. 5 and 8, the slidable plate 36 has a cutout 38 therein which is located at a position directly opposed to the protruded portion 28 so as to "snap" the sleeve 24 and second connector 30 together as aforementioned.

Figure 11:
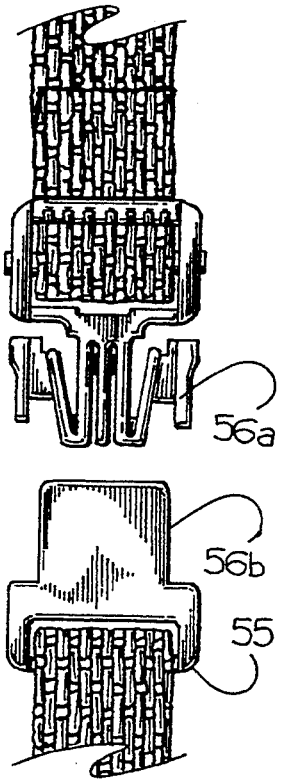
FIG. 11 shows a perspective view of a typical strap used with a buckle fastener to further secure an object being holstered against the frame.

The subject holster 10 may also comprise a plurality of additional strap apertures 23 defined by frame 20 through which an additional strap 55 or fasteners may be secured such as the one shown in FIG. 11. For example, a VELCRO 54 or buckle 56 having male end **56*a* and female end 56*b* strap 55 may be secured through the strap aperture 23. The adjustable VELCRO 54 or buckled strap 55 is suitable for securing the lens of a camera in a downward position or the body of a video camera or other object and permits cameras of various lengths to be holstered using the subject apparatus. Such a strap may also be used to secure an extended end of any holstered object, other examples including flashlights, portable tools and mobile telephones. Although a strap 55 having a buckle closure 56 is preferred, it is to be understood that any suitable closing means (e.g., VELCRO 54, snaps, ties, hooks and eyes, buttons, etc.) may be employed to secure the strap 55** in a closed position.

An additional embodiment of the instant invention is depicted in FIGS. **13–20*a*. In this embodiment the frame 60 generally comprises a front side 62, a backside 64, a lower lip 66 and an upper lip 68. The first connector, as previously discussed, is referenced in this embodiment as a female support adapter 70. The female support adapter 70 projects from the front side 64 and provides a curved recession 72 for receiving and mating with a male support adapter 80 which projects from the object to be held. The female adapter 70 is preferably integrally formed with the frame 60 but may be fixedly secured by glue, rivets, hardware, adhesives, or the like, to the front side 64 and still be in conformity with the object of the instant invention. Likewise, the male adapter 80 provided is preferably fixedly secured to the object to be held by glue, rivets, adhesives, hardware or the like, but it may be integrally formed therewith and still fall within the scope of the instant invention. A mating notch 74 is defined by a void between the curved recession 72 and the front side 64. This notch 74 facilitates the secured mating of the male adapter 80 and the female adapter 70. In the preferred embodiment, the male adapter is substantially cylindrical such that it's dimensions correspond to the recession 72 to provide a snug and secured fit. Moreover, a circumferential groove 82 is provided in the male adapter 80 which matingly corresponds to the notch 74 found on the frame 60. When the male adapter 80 is slipped into the female adapter 70 the corresponding notch 74 and groove 82 interlock to secure the object to the frame 60. The interlocking of the male adapter 80 and female adapter 70 is further effectuated by a securing nipple 63 which projects from the front side 62. The front side 62 is without reinforcement around notch 74 and in proximity to the nipple 63 it is slightly resilient near the void defined by the notching for easier removal of the male adapter 80 when desired. Below the female adaptor, a vanity block 65 is provided for displaying names, company logos or whatever is desirous. The block 65 rests on the front side 62 and is attached by glue, machining, rivets, clamping or other similar means. The block 65 is shown in phantom in FIGS. 13 and 14**.

A third locking mechanism forms another important feature of this additional embodiment. The third locking mechanism comprises an elongated channel 92, a planer securing member 94 and a slidable key 96. The channel 92 is an elongated opening defined by the front side 62 above the female adapter 70. The channel 92 extends above and across the female adapter 70 from one end of the recession 72 to slightly beyond the recession 72 at its other end. The planer securing insert 94 fits snugly between the lower lip of 66 and the upper lip 68 against the backside 64. The member 94 is preferably machined, clamped or secured therein by some similar means during the fabrication of the frame 60 so that it remains as a permanent piece. The upper and lower lips 68, 66 leave an opening sufficient to exert an axial force on the member 94. An elongated securing projection 95 protrudes and extends across the insert 94 such that it aligns with, faces and abuts channel 92. The slidable key 96 is an elbow shaped member which maintains a shape in conformity with the contours of the frame from the channel 92 to the top surface of upper lip 68. The key 96 has a key projection 97 at its lower end **96*b* which intersects channel 92, riding within the channel 92 and against the securing projection 95. This enables the securing projection 95 to exert a force on the key projection 97 to tighten the control of the key 96 when causing the key projection to move along channel 92. Meanwhile, the upper end 96*a* of the key 96 is manually moved by the operator from an open position to a locked position so that it skates along the top surface of upper lip 68. In the open position, the key 96 remains clear of the recession 72 so that the male adapter 80 may join the female adapter 70. The key 96 is secured in the open position by a first nipple 98 which protrudes from the top of upper lip 68. To achieve the locked position the key 96 is traversed to the opposite end of the channel such that its upper end 96*a* must overcome the first nipple 98 and a second nipple 99. The second nipple 99 secures the key 96 in the locked position, which is over the recession 72 and the male adapter 80 found therein. The key 96 is preferably diagonally over the recession 72 so that any upward motion of the male adapter 80** only encourages the locked position.

A plurality of spacers 61 are provided for insertion between the upper lip 68 and the lower lip 66 outside the securing insert 94. The spacer 61 maintains a height slightly greater than the opening between the lower lip 66 and upper lip 68 such that an inward or axial force provides added support. The spacer 61 also includes resilient nipples **63*a* and 63*b* which engage with corresponding apertures 93*a* and 93*b* on the lower and upper lips 66, 68. The nipples 63*a,b* give added security and are resilient for easier removal of the spacer 61. The nipples 63*a,b* protrude from a bridge over apertures to give the resiliency. The spacer 61 are inserted such that the belt worn by the user lies interposed between the securing insert 94 and the spacer 61. Normally, only one spacer 61 is needed whereby the spacer 61 is fabricated in varying thicknesses as depicted by spacer 61*a* and 61*b* in FIG. 12 to accommodate a variety of belts. The spacer 61 and frame 60 comprise a combination which provides an alternative method for attaching the holster combination to a variety of belts as compared to the apertures 22 utilized in the first embodiment. Finally, grooves 100*a* and 100*b* are provided along the lower end of backside 64 and the securing member 94, respectively, such that a strap channel 100 is formed when the securing member 94 is inserted. The strap channel 100 facilitates an additional securing means whereby a security strap 55 is inserted therein for fastening around the object holstered. The strap 55 includes a male buckle 56*a* and female buckle 106** for fastening the strap but other closing devices such as VELCRO, snaps, ties, hooks and eyes, buttons any like may be employed.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi-purpose holster apparatus for holding objects, which comprises:

(a) a frame having peripheral side edges;

(b) a plurality of belt apertures defined by said frame side edges, said plurality of belt apertures for receiving a belt or waistband to support said frame on a person;

(c) a rigid support member for attaching and supporting an object, said support member having a means for attaching the object to said support member;

(d) a slidable plate integrally formed with said support member;

(e) a sleeve integrally formed with and protruding from said frame, said sleeve for mating with said slidable plate to releasably attach said support member and object to said frame, said sleeve defining a cutout to provide clearance for said support member, said sleeve having an upper end and a lower end, said sleeve upper end being at least as wide as said sleeve lower end;

(f) an elongated projection protruding from said frame proximal to said sleeve cutout, said projection being substantially horizontal with respect to said sleeve cutout upper end; and (g) an interlocking cutout defined by said slidable plate, said interlocking cutout corresponding to said elongated projection, said interlocking cutout and said projection being interlocked when said slidable plate mates with said sleeve for releasably locking said slidable plate in said sleeve.

2. An apparatus according to claim 1, further comprising:

a securing strap having opposite ends, said strap for wrapping around the object to increase the security of the object holstered against said frame;

a plurality of strap apertures defined by said frame side edges for threading said strap through when securing the object holstered against said frame; and a fastening means attached to said strap ends for joining said strap ends.

3. An apparatus according to claim 2, wherein said fastening means comprises a buckle.

4. An apparatus according to claim 2, wherein said fastening means comprises hook and loop fasteners.

5. An apparatus according to claim 1, further comprising;

a locking member pivotally mounted on said frame for preventing the removal of said slidable plate, said locking member having a depending plug;

a plug aperture defined by said frame and located above said sleeve for receiving said plug when mounting said locking member to said frame.

6. An apparatus according to claim 1, wherein said frame further comprises;

a center portion raised above said peripheral side edges; and a notch defined by said center portion, said notch proximal said elongated projection for causing said center portion to be slightly resilient for easier removal of said slidable plate.

7. An apparatus according to claim 1, further comprising:

a belt having opposite ends, said belt mounted through said plurality a belt apertures, said belt for supporting said frame on a person'body.

8. An apparatus according to claim 1, wherein said means for attaching comprises an aperture defined by said support member for receiving a bolt, said bolt for attaching the object to said support member, wherein said bolt mates with a corresponding threaded port on the object.

9. A multi-purpose holster apparatus for holding objects, said apparatus comprising:

a frame having a front side, a backside, an upper lip and a lower lip;

a female adapter protruding from said front side;

a male adapter securedly fixed to the object to be holstered, wherein said male adapter mates with said female adapter to secure the object to said frame;

a planar securing member located against said backside and between said upper lip and said lower lip;

at least one spacer inserted between said upper lip and said lower lip;

said at least one spacer having a height slightly larger than the distance between said lips so that said upper lip and said lower lip exert an inward force to secure said spacer, said spacer and said securing member defining a space therebetween for receiving a belt or waistband to support the frame on the belt of a person, said at least one spacer providing a force against the belt to secure said frame to the belt;

a locking mechanism attached to said frame for preventing the removal of said male adapter from said female adapter.

10. An apparatus according to claim 9, wherein said locking mechanism comprises:

a channel defined by said frame, said channel located above said female adapter;

a key having an upper end and a lower end;

a key projection protruding from the lower end of said key, said key projection inserted in said channel;

a securing projection protruding from said planar securing member, said securing projection being in alignment with said channel for applying a force against said key projection;

a first nipple protruding from said frame to secure said upper end of said key to hold said key in an open position; and a second nipple projecting from said frame for securing the upper end of said key to hold said key in a locked position.

11. An apparatus according to claim 9, further comprising:

a securing strap for additional securing of the object against said frame to inhibit movement of the object;

a strap channel defined by space between said planer securing member and said backside for receiving the securing strap;

a fastening means attached to said strap for connecting the strap at its ends.

12. An apparatus according to claim 11, wherein said fastening means comprises a buckle.

13. An apparatus according to claim 11, wherein said fastening means comprises hook and loop fasteners.

14. An apparatus according to claim 9, said apparatus further comprising:

a notch defined by said female adapter and said front side for receiving said male adapter; and a groove defined by said male adapter for interlocking with said notch.

15. An apparatus according to claim 9, wherein said female adapter comprises a curved recession.

16. An apparatus according to claim 9, wherein said male adapter is substantially cylindrical.

17. An apparatus according to claim 9, further comprising:

a securing nipple projecting from said front side for increasing a force against said male adapter.

18. An apparatus according to claim 9, wherein said at least one spacer has a height substantially equal to the distance between said upper lip and said lower lip so that said upper lip and said lower lip secure said spacer therebetween.

19. A multi-purpose holster apparatus for holding objects, said apparatus comprising:

a belt for attachment to a person;

at least one first holster mounted to said belt for supporting at least one first object;

at least one second holster mounted to said belt for supporting at least one second object;

said first holster comprising:

a first frame having peripheral side edges;

a plurality of belt apertures defined by said first frame side edges for receiving said belt to support said first frame on said belt;

a rigid support member for attaching said at least one first object, said support member having a means for attaching said at least one first object to said support member;

a slidable plate integrally formed with said support member;

a sleeve integrally formed with and protruding from said first frame, said sleeve for mating with said slidable plate to releasably attach said support member to said first frame, said sleeve defining a cutout for providing clearance for said support member, said sleeve cutout having an upper end and a lower end, said sleeve upper end being at least as wide as said sleeve lower end lower end;

an elongated projection protruding from said first frame and proximal to said sleeve cutout, said projection being substantially horizontal;

an interlocking cutout defined by said slidable plate, said interlocking cutout corresponding to said elongated projection so that said interlocking cutout and said projection interlock when said slidable plate mates with said sleeve;

said at least one second holster comprising:

a second frame having a front side, a backside, an upper lip and a lower lip;

a planar securing member located against said backside and between said upper lip and said lower lip;

a female adapter protruding from said front side;

a male adapter securedly fixed to said at least one second object wherein said male adaptor mates with said female adapter to secure said at least one second object to said second frame; and a locking mechanism attached to said second frame for preventing the removal of said male adapter from said female adapter, said planar securing member exerting a force on said locking mechanism; and at least one spacer inserted between said upper lip and said lower lip operatively associated with said planar securing member for securing said second frame to said belt, said at least one spacer and said securing member defining a space therebetween for receiving said belt and exerting a force on said belt sufficient to support and secure said at least one second holster on said belt.

20. An apparatus according to claim 19, further comprising:

a first securing strap for additional securing of said first object against said first frame to inhibit movement of said first object;

a plurality of first securing strap apertures defined by said first frame for receiving said first strap to further secure said first object holstered against said first frame;

a first fastening means attached to said first strap for joining said first strap at its ends;

a second securing strap for additional securing of said second object against said second frame to inhibit movement of said second object;

a channel defined by said planar securing member and said backside therebetween for receiving said second securing strap;

a second fastening means attached to said second strap for joining said second strap at its ends.

21. An apparatus according to claim 20, wherein said first fastening means comprises hook and loop; and said second fastening means comprises hook and loop.

22. An apparatus according to claim 19, further comprising:

a locking mechanism attached to said second frame for preventing the removal of said male adapter from said female adapter, said locking mechanism having:

a channel defined by said second frame, said channel located above said female adapter;

a key having an upper end and a lower end;

a key projection protruding from the lower end of said key, said key projection inserted in said channel;

a securing projection protruding from said planar securing member, said securing projection being in alignment with said channel for applying a force against said key projection;

a first nipple protruding from said second frame to secure said upper end of said key to hold said key in an open position; and a second nipple projecting from said frame for securing the upper end of said key to hold said key in a locked position.

23. A multi-purpose holster apparatus for supporting an object on a belt by interlocking with a male adapter protruding from the object, said apparatus comprising:

a frame having a front side, a backside, an upper lip and a lower lip;

a female adapter protruding from said front side for mating with the male adapter to secure the object to said frame;

a slidable locking mechanism attached to said frame for preventing the removal of said male adapter from said female adapter; and at least one spacer inserted between said upper lip and said lower lip, said at least one spacer having a height slightly larger than the distance between said lips so that said upper lip and said lower lip exert an inward force to secure said spacer, said at least one spacer and said frame defining a space therebetween for receiving a belt to support said frame on the belt of a person, said at least one spacer providing a force against the belt to secure said frame to the belt.

24. An apparatus according to claim 23, wherein said slidable locking mechanism comprises:

a channel defined by said frame, said channel located above said female adapter;

a key having an upper end and a lower end;

a key projection protruding from the lower end of said key, said key projection inserted in said channel;

a securing member located against said backside between said upper lip and said lower lip contiguous with said channel for applying a force against said key projection;

a first nipple protruding from said frame to secure said upper end of said key to hold said key in an open position; and a second nipple projecting from said frame for securing the upper end of said key to hold said key in a locked position.

* * * * *